US006354533B1

(12) United States Patent
Jespersen

(10) Patent No.: US 6,354,533 B1
(45) Date of Patent: Mar. 12, 2002

(54) WEB TRANSFER MECHANISM FOR FLEXIBLE SHEET DISPENSER

(75) Inventor: Paul W. Jespersen, Salt Lake City, UT (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 09/383,019

(22) Filed: Aug. 25, 1999

(51) Int. Cl.[7] ..... B65H 19/10; B65H 20/02
(52) U.S. Cl. ..... 242/560.1; 242/564.4
(58) Field of Search ..... 242/562.1, 564.4, 242/560, 560.1; 226/92, 91; 312/34.22

(56) References Cited

U.S. PATENT DOCUMENTS

| | | | | |
|---|---|---|---|---|
| 2,930,663 A | | 3/1960 | Weiss | 242/560.1 |
| 3,007,650 A | | 11/1961 | Burton | |
| 3,269,592 A | | 8/1966 | Slye et al. | 221/44 |
| 3,288,387 A | | 11/1966 | Craven, Jr. | |
| 3,628,743 A | | 12/1971 | Bastian et al. | 242/560.1 |
| 3,858,951 A | | 1/1975 | Rasmussen | 312/34.12 |
| 3,917,191 A | | 11/1975 | Graham, Jr. et al. | 242/560.1 |
| 4,165,138 A | | 8/1979 | Hedge et al. | |
| 4,358,169 A | * | 11/1982 | Filipowicz et al. | 242/560.1 |
| 4,378,912 A | | 4/1983 | Perrin et al. | |
| 4,712,461 A | | 12/1987 | Rasmussen | |
| 4,756,485 A | | 7/1988 | Bastian et al. | |
| 4,807,824 A | | 2/1989 | Gains et al. | |
| 4,846,412 A | | 7/1989 | Morand | |
| 5,244,161 A | | 9/1993 | Wirtz-Odenthal | |
| 5,302,167 A | | 4/1994 | Kley et al. | |
| 5,400,982 A | | 3/1995 | Collins | |
| 5,526,973 A | | 6/1996 | Boone et al. | |
| 5,772,291 A | | 6/1998 | Byrd et al. | |
| 5,979,822 A | * | 11/1999 | Morand et al. | 242/560 |
| 6,145,779 A | * | 11/2000 | Johnson et al. | 242/560.1 |

* cited by examiner

*Primary Examiner*—John M. Jillions
(74) *Attorney, Agent, or Firm*—Banner & Witcoff, Ltd.

(57) ABSTRACT

A dispenser sequentially dispenses web material from a working web roll and then a reserve web roll. A web sensing mechanism senses the presence of the working web at a back side of the main feed roller and introduces the leading end of the reserve web roll to a feed nip defined by two feed rollers immediately after the trailing end of the working web roll passes over a back side of the feed roller. Web sensing, and controlled introduction of the leading end of the reserve web to the feed nip, are carried out by a simple and effective interaction of a grooved main feed roller, and a pair of pivotable lever arms—a web sensing arm mounted at the backside of the rollers, and a transfer arm mounted at the front side. The mechanism avoids double feeding of web by sensing the presence or absence of web at the back-side of the main feed roller. Transfer fingers of the transfer arm are movable against the reserve roll web and into corresponding grooves in the main feed roller such that a leading end portion of the reserve roll web is reliably moved into the vicinity feed roller nip, where serrations provided in the edges of the grooves facilitate a gripping of the leading end portion to pull the web through the nip. The feed path is arranged to extend away from the transfer fingers so as to avoid interference of the transfer fingers with the subsequent feeding of the web.

22 Claims, 7 Drawing Sheets

WEB TRANSFER MECHANISM FOR FLEXIBLE SHEET DISPENSER

BACKGROUND OF THE INVENTION

The present invention relates to flexible sheet dispensers for sequentially dispensing a web of material from a plurality of rolls, and in particular to an automatic transfer mechanism for transferring the feed supply from a working roll to a reserve roll, upon exhaustion of the working roll.

Industrial dispensers for toweling are primarily designed to dispense either a continuous length of web material, folded paper towels, or rolls of paper towels. Continuous towels are generally made of a reusable material and form a towel loop outside of the dispenser cabinet for the consumer to use. Folded towels are paper towels which are pre-cut and folded into various configurations to be individually dispensed for use. Roll towels are continuous rolls of paper toweling which are wound around a cardboard core and which are, upon dispensing, separated into and delivered as individual lengths of material.

Continuous web dispensers, such as those disclosed in U.S. Pat. No. 2,930,663 to Weiss and U.S. Pat. No. 3,858,951 to Rasmussen, require the user to pull on the loop of exposed toweling in order to cause a length of clean toweling to be dispensed and the exposed soiled toweling to be correspondingly taken up within the dispenser. Although economical, the continuous exposure of the soiled toweling is deemed unsightly, and therefore unacceptable to many consumers when compared to the many available alternatives. Further, the exposure and possible reuse of soiled toweling may present additional health hazards and sanitation concerns which should be avoided.

The use of either interfolded paper towels or C-fold paper towels eliminates the potential health risks associated with continuous web toweling. Dispensers for folded paper towels allow a user to pull the exposed end of a new individual towel in order to dispense the towel. These dispensers, such as the one disclosed in U.S. Pat. No. 3,269,592 to Slye et al., are also easy to refill with folded towels, That is, when the dispenser is partially empty, the cover can simply be removed and the remaining stack of towels can be replenished through the open top. Folded towels are, however, not usually the most economical alternative for institutional or other high-volume situations.

Roll towels are cheaper to manufacture than folded towels and also eliminate the potential health and sanitation problems associated with continuous web toweling systems. Dispensers for roll towels usually include a lever, crank, or other user-activated mechanism for dispensing a length of towel and a blade for then severing the length of towel from the remaining roll. In contrast to folded towels, however, there is no way to simply replenish a partially depleted roll of web material in a roll dispenser. In some prior art dispensers, a new roll must be substituted thereby resulting in the waste of the partially depleted roll, or "stub" roll. To overcome the problem of stub roll waste, roll dispensers have been designed to dispense two rolls of web material sequentially such that upon depletion of a primary roll, feeding from a reserve roll is commenced. Prior art systems have accomplished this transfer by either modifying the end of the web material or modifying the roll core upon which the web material is wound, such as the system disclosed in U.S. Pat. No. 3,288,387 to Craven, Jr. Alternatively, the system of U.S. Pat. No. 3,628,743 to Bastian et al. senses the diameter of the primary roll in order to activate the transfer to the reserve roll, and the system of U.S. Pat. No. 3,917,191 to Graham, Jr. et al. senses the tension in the primary roll in order to detect when it is nearly exhausted. Unfortunately, tension responsive transfers are not particularly reliable since conditions other than reaching the end of the roll can trigger their operation, such as the slackening of the web or a break in the web material. Diameter responsive transfers also have a drawback in that the reserve web begins dispensing prior to the complete exhaustion of the primary roll. Thus, for a short time web material is dispensed simultaneously from both rolls and again results in a waste of material.

To overcome these disadvantages, the systems of U.S. Pat. No. 4,165,138 to Hedge et al. and U.S. Pat. No. 4,378,912 to Perrin et al. provide a transfer mechanism which is based on the feed rolls themselves. These systems utilize a transfer mechanism which senses the absence or presence of paper around a grooved feed roll by using a sensing finger which rides along the top surface of the web material and which then drops down into the groove in the feed roll when the trailing end of the primary web has passed thereover and thus uncovers the groove. Responsive to the movement of the sensing finger into the groove, the reserve web is introduced into the feed nip between the feed rolls and dispensing from the reserve roll begins. This type of transfer mechanism generally eliminates the false transfer associated with tension responsive systems and reduces the amount of double sheet dispensing which occurs in other prior art diameter and end of roll responsive systems. The use of sensing fingers on the web material, can, depending on the design, produce extra friction which can inadvertently tear the web. Also, the introduction of additional components to sense the absence of the web and transfer the reserve web into the feed nip between the feed rollers creates additional opportunities for a transfer failure or interference with web feed to occur. In particular, in each of the designs of the Hedge et al. and Perrin et al. patents, a tucking device (blade or roll) is used. The device pivots into very close proximity to the feed nip, and remains there through the subsequent dispensing from the reserve roll. It is evident that interference with the web feed from the reserve roll could result if proper positioning of the transfer device, away from the nip, is not maintained.

A need has therefore existed for a flexible sheet dispenser having an automatic transfer mechanism which, in addition to substantially eliminating simultaneous dispensing from both primary and reserve rolls, requires few additional parts within the dispenser and which is not prone to interference with the proper dispensing of either the working or reserve roll web material. A transfer mechanism that, to a large extent, fulfills this need is described in commonly assigned U.S. Pat. No. 5,526,973 to Boone et al. Therein, movement and interengagement of one grooved feed roller relative to the other upon depletion of a stub roll, actuates a transfer mechanism that introduces a reserve web into the feed nip. While generally quite effective, the movement and spring biasing of a relatively high mass feed roller can lead to difficulties. The feed roller spring bias force must be within a relatively narrow window. If the spring bias is set too high, the biasing force may inhibit smooth feeding of the web material through the rollers, and result in tearing of the web material. If it is set too low, the mechanism may not actuate effectively to cause a transfer of feed to the reserve roll immediately upon depletion of the stub roll. Over time, the spring bias provided to move one roll relative to the other is prone to eventually decrease, e.g., due to fatigue of the spring, such that ultimately the spring force may fall below the required relatively narrow range and thus be insufficient to properly actuate a web transfer. There thus remains a need for an automatic web transfer mechanism that can provide increased reliability, robustness and cost effectiveness.

SUMMARY OF THE INVENTION

In view of the foregoing, it is a principal object of the present invention to provide a web transfer mechanism for a flexible sheet dispenser having increased reliability, robustness and cost effectiveness.

It is a further object of the invention to provide a web transfer mechanism which permits simple set-up/loading of the dispenser for sequential dispensing from a working roll and then a reserve roll.

It is another object of the present invention to provide a web transfer mechanism that avoids double feeding of web from the reserve roll and working (stub) roll.

A further object of the present invention is to provide a web transfer mechanism which is removed from the web feed path about the feed roll, such that post-transfer interference with web feed from the reserve roll is reliably avoided.

These and other objects are achieved, in accordance with a first aspect of the present invention, by a web transfer mechanism for providing, in a flexible sheet material dispenser, automatic transfer of web feed from a working roll to a reserve roll. A pair of feed rollers forms a nip for receiving a leading end of a sheet material web. A first one of the feed rollers includes at least one circumferential groove. A first arm is movably mounted adjacent and to one side of the first feed roller. The first arm includes a web transfer finger. The finger is movable into contact with a leading end portion of a sheet material web from the reserve roll positioned on the one side of the first feed roller, to a transfer position close enough to the first feed roller to move the leading end portion into the vicinity of the nip such that upon driving of the rolls the web is carried through the nip and along a path avoiding subsequent contact of the web with the finger. A second arm is movably mounted adjacent and to a second side of the first feed roller. The second arm includes a web sensing finger biased toward the feed roller into a web-present sensing position wherein the sensing finger rides lightly upon the surface of a sheet material web as it passes around the first feed roller, and such that when no sheet material web is present the sensing finger moves into a no-web-present position within one of the circumferential grooves. A stop arm is movably connected to the second arm. The second arm is capable of assuming a stop position preventing the web transfer finger from moving into the transfer position when the web sensing finger is in the web-present sensing position. The stop arm is movable with the second arm to a release position allowing the web transfer finger to move into the transfer position when the second arm moves into the no-web-present position.

A second aspect of the invention is likewise embodied in a web transfer mechanism for providing, in a flexible sheet material dispenser, automatic transfer of web feed from a working roll to a reserve roll. A first one of a pair of feed rollers forming a nip for receiving a leading end of a sheet material web includes at least one circumferential groove with serrations formed in a sidewall thereof A web transfer arm is movably mounted adjacent the first feed roller. The arm is movable into contact with a leading end portion of a sheet material web from the reserve roll, positioned on a side of the first feed roller, to a transfer position close enough to the first feed roller to move the leading end portion into the vicinity of the nip such that upon driving of the feed rollers the web of the reserve roll is gripped by the first feed roller, assisted by the serrations, and carried through the nip.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
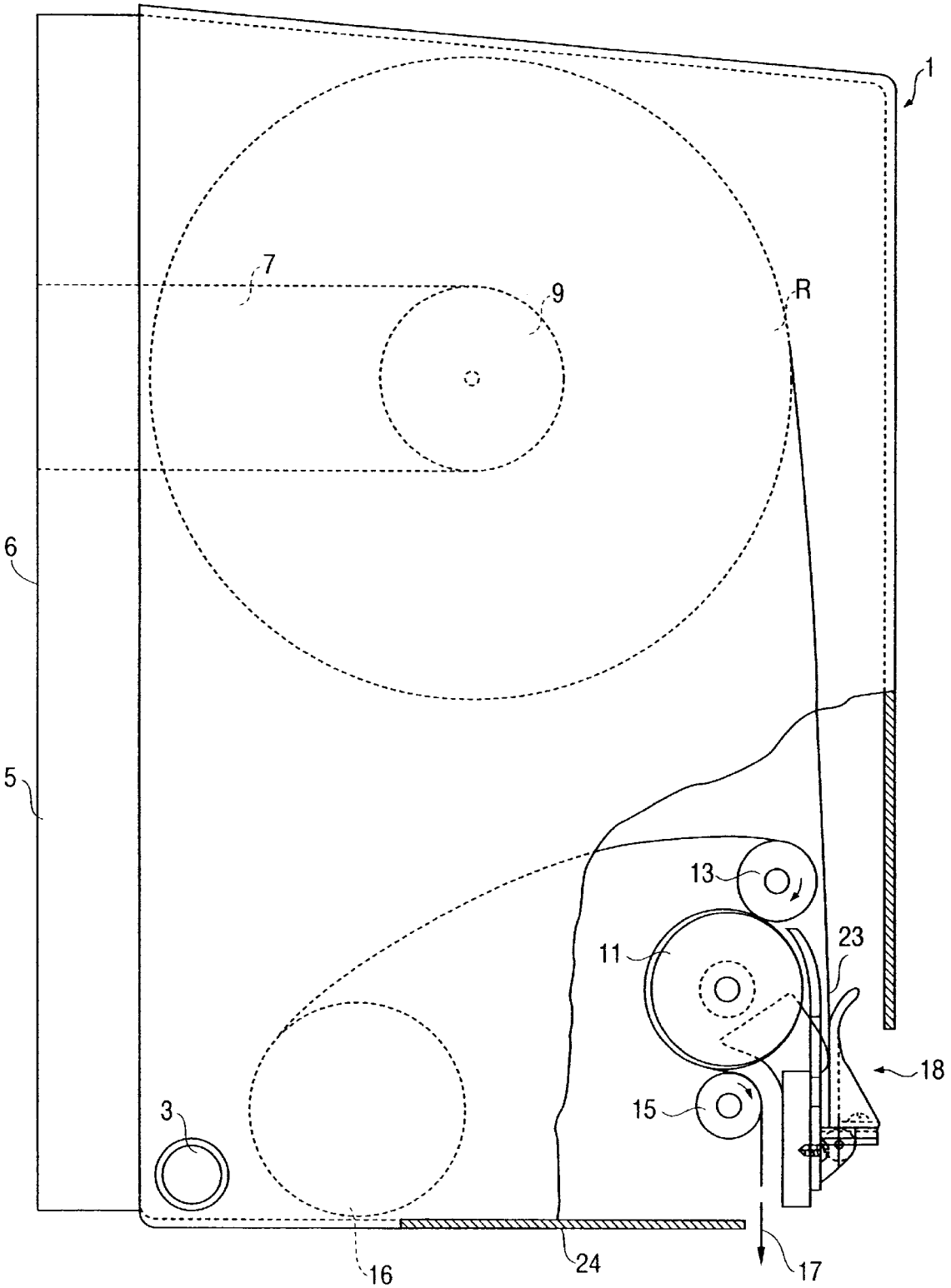
FIG. 1 is a side elevational view of a rolled material dispenser with a housing portion cut-away to reveal, in left end-view, a web feed roller arrangement and associated sub-assembly, including a reserve roll web retaining mechanism in accordance with the invention.

Referring to FIG. 1, the general outline of a conventional-style dispenser cabinet or housing is illustrated. The dispenser housing comprises a five-sided cover member 1 pivotably mounted at pivot point 3 to a shallow tray-like base member 5. Base member 5 has a back wall 6 provided with appropriate openings (not shown) to accommodate fasteners for attachment of the dispenser to a wall.

Figure 12:
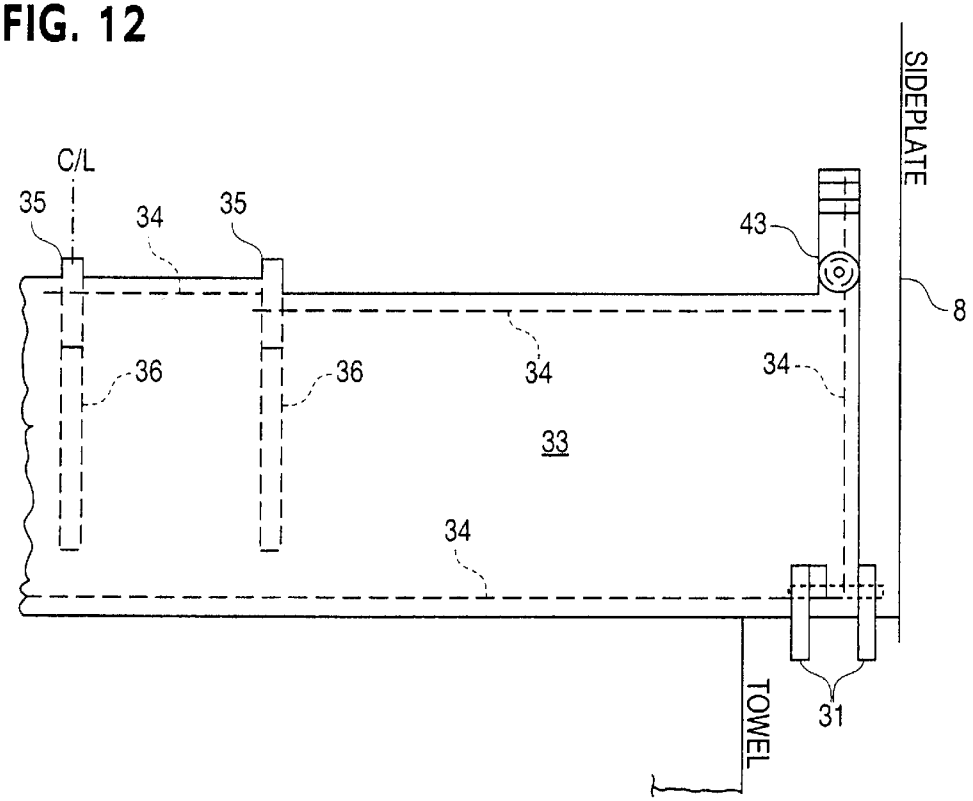
FIG. 12 is a partial front side elevational view of the transfer arm shown in FIG. 11, shown in relation to a side plate of the dispenser chassis, and a dispensed towel.

A reserve roll R of flexible sheet material, such as paper toweling, may be suitably supported between a pair of cantilever mounted wing members 7 extending from the inside of back wall 6. Each wing member 7 carries a cup 9 at its free end, which enters into the opposite ends of the core of reserve roll R. This mounting of reserve roll R within a dispenser housing is fairly conventional, and thus no further discussion of such structure is required. Additional generally well known features of the dispenser include a pair of side plates 8 (see, e.g., FIGS. 3 and 12) extending along the opposite sides of the dispenser in the lower part thereof. Side plates 8 serve to provide rotatable mounting locations for the feed rollers and other operative components of the dispenser, to be described.

The feed rollers include a main feed roller 11, and upper and lower pinch rolls 13 and 15. An opening 17 at the lower front portion of dispenser housing 1 provides a dispenser exit, i.e., towel access slot. As shown, the web being dispensed is provided by a stub roll 16 held loosely in a compartment formed by cover 1 below reserve roll R. Extending along and in close proximity to the towel access slot is a reserve roll web (leading end) retaining mechanism 18.

Although not shown nor absolutely required, typically the inventive web transfer mechanism will be implemented in a dispenser including a mechanism for providing motorized or manual web feed control, e.g., a motor or manual crank for driving the feed rollers, and a web cutting mechanism. Such mechanisms are well known in the art.

Figure 2:
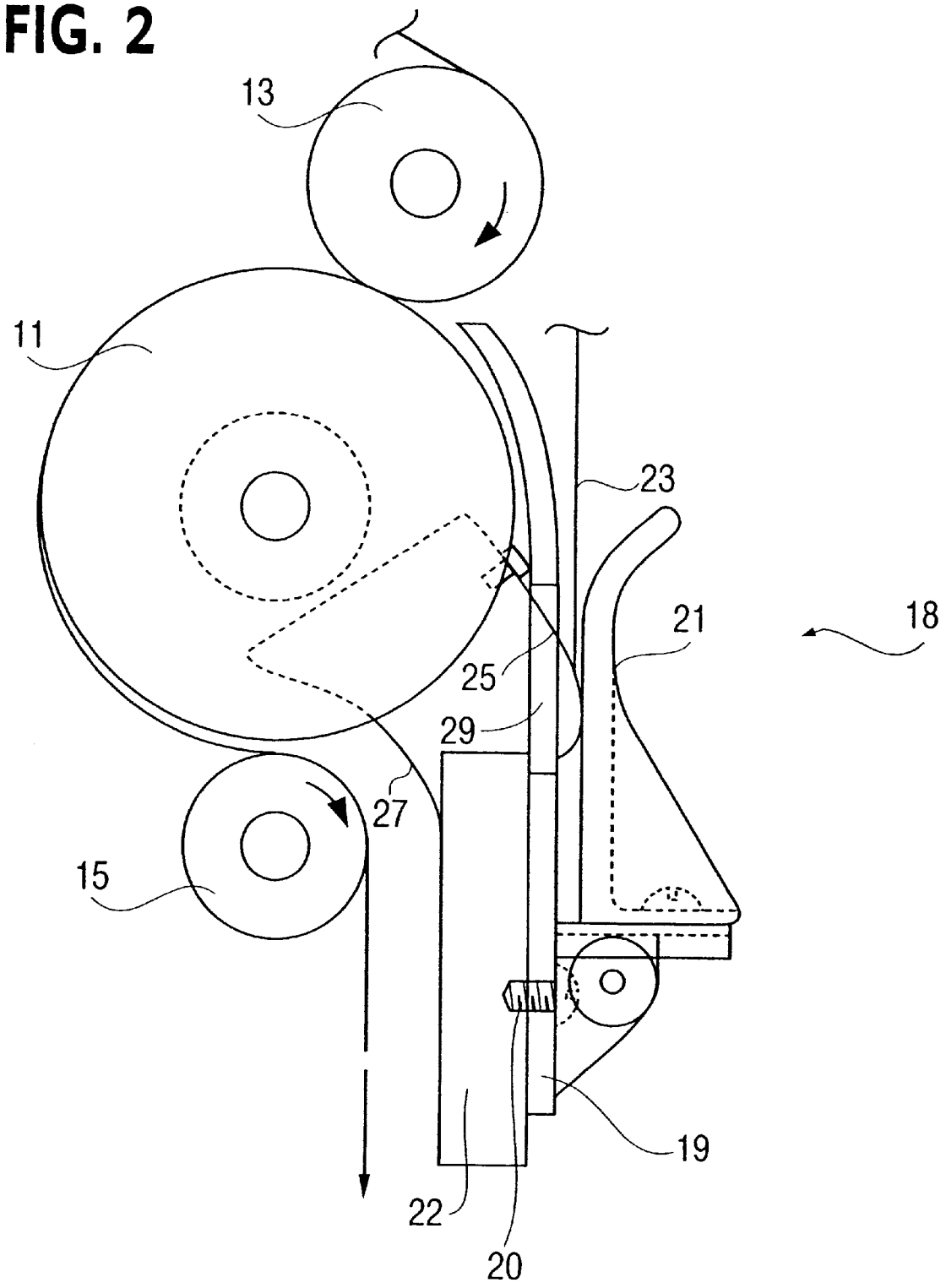
FIG. 2 is an enlarged left end view of the web feed roller arrangement and associated sub-assembly shown in FIG. 1.

FIG. 2 shows more clearly various operative parts of web retaining mechanism 18 positioned at the front side of main feed roller 11. A shield 19 extending across the full width of the feed roller is secured by screws (e.g., 20), adhesive or the like, to the rectangular base of a generally conventional stripper bar 22. Stripper bar 22 has arms 27 serving to strip web from main feed roll 11 upon emerging from the nip formed between main feed roller 11 and lower pinch roll 15. As shown, the leading end portion 23 of the web from roll R (see FIG. 1) fits into a space between shield 19 and each of a plurality of upstanding web retainer plates 21. A narrow flat spring 25 is fastened to each of a plurality (e.g., a pair) of stripper bar arms 27 extending into grooves 38 (see FIG. 13) in main feed roller 11. Springs 25 project through respective openings 29 in shield 19, to hold the web leading end 23 in place for a subsequent transfer of web end 23 into the nip formed between main feed roller 11 and upper pinch roller 13. Together, retainer plate 21 and spring 25 constitute a web retainer clip.

Figure 3:
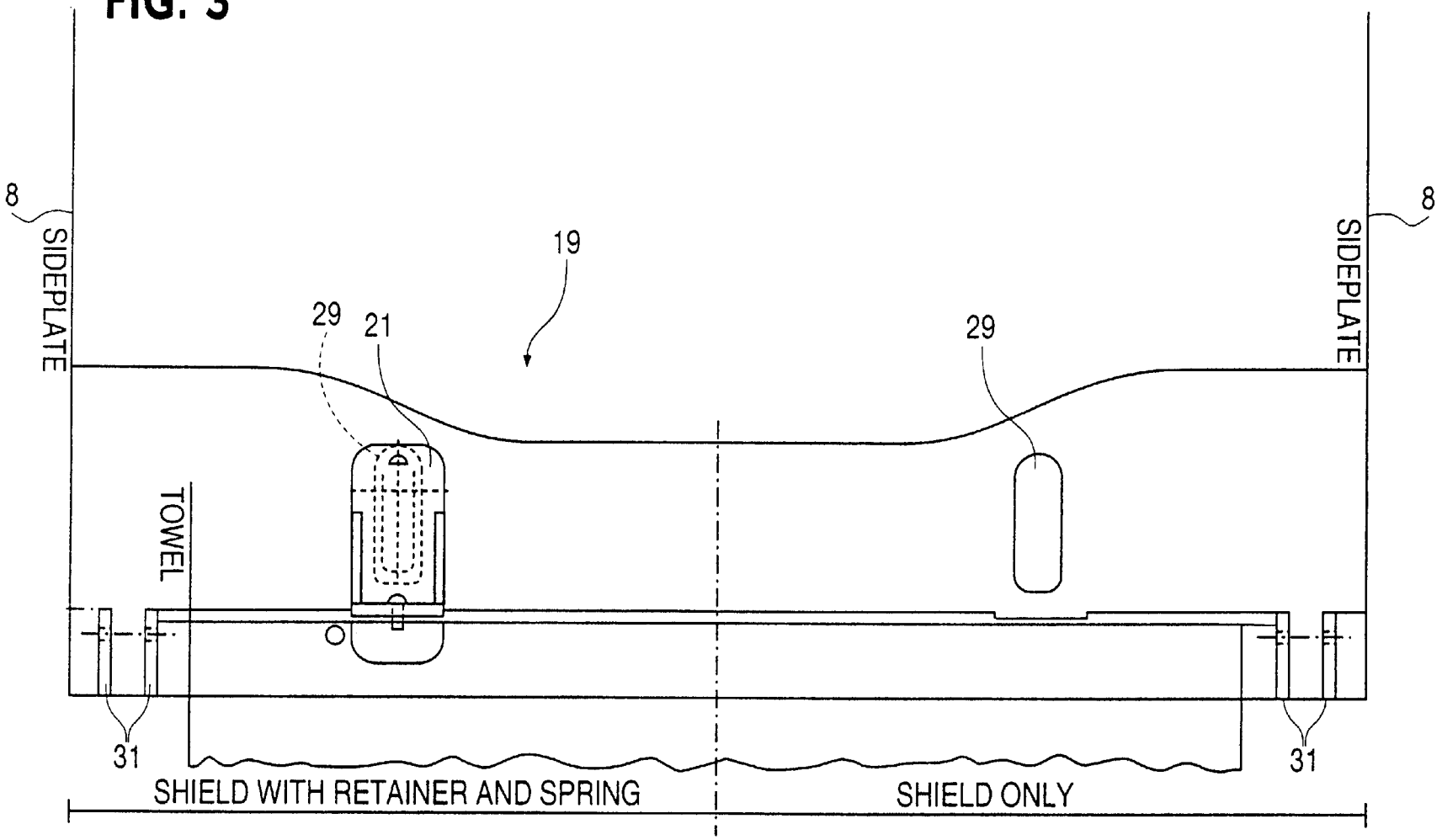
FIG. 3 is a front elevational view of a shield structure forming part of the sub-assembly seen in FIG. 2, extending along and in close proximity to the main feed roll; associated structure is removed on the right half to show the shield without obstruction.
Figure 13:
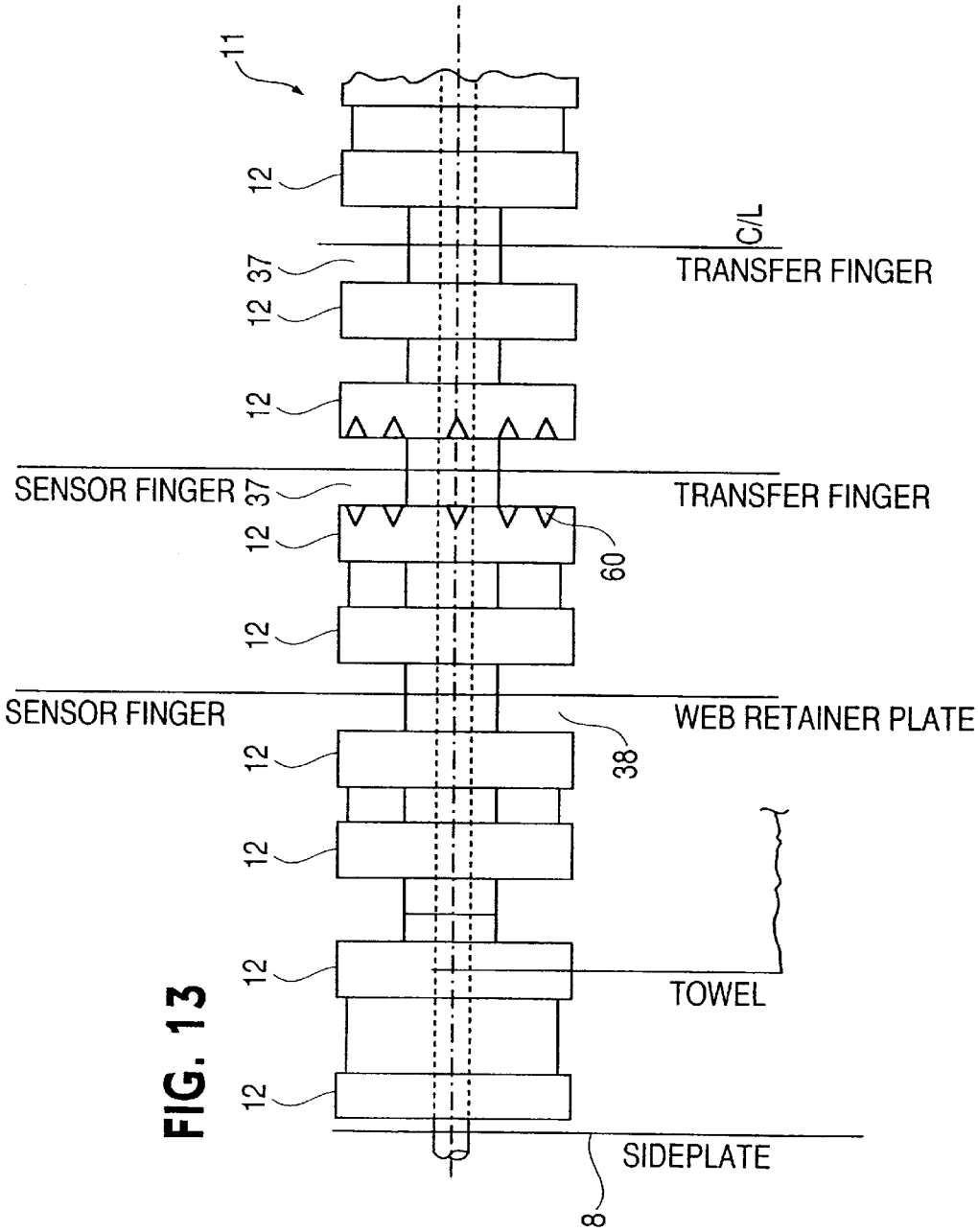
FIG. 13 is a partial top plan view of a grooved main feed roller in accordance with the present invention, with relative positions of related operating components figuratively illustrated.

As seen in FIG. 3, shield 19 has a pair of flanges 31 at each of its lateral ends, on which a gravity-controlled pivotable transfer arm 33 (see FIGS. 4, 5, 11 and 12) may be hingedly mounted, at a position below and on a front side of main feed roller 11. Transfer arm 33, formed primarily as a flat tray-like structure with inwardly directed strength imparting end, bottom and top flanges 34 (see FIGS. 11 and 12), carries a plurality (e.g., three) transfer fingers 35 (two seen in FIG. 12) located at, and on either side of, a centerline of arm 33, in alignment with corresponding feed roller grooves 37 (two seen in FIG. 13). For strength, transfer fingers 35 may be formed as integral extensions of flat-sided vertical ribs 36 protruding from an inside face of transfer arm 33. The flange 34 located between transfer fingers 35 extends inwardly to a greater extent than the other flanges, in order to provide additional stiffening of the fingers. As best seen in FIG. 13, main feed roller 11 has circumferential friction (e.g., rubber) surface elements 12 to grip and move the web, and deep grooves at spaced intervals along its length. Three grooves 37 (placed at and on either side of a center line of roller 11) accommodate transfer fingers 35 at the front side of the feed roller. Each groove 37 off-set from centerline groove 37 further accommodates, at the rear side of roller 11, web sensing fingers, as will be described. A pair of grooves 38 (one shown), adjacent the off-set grooves 37, are aligned with a corresponding one of web retainer plates 21 on the front side, and receives a stripper bar arm 27 at a lower front side, as best seen in FIG. 2. At the rear side of main feed roller 11, grooves 38 accommodate an additional web sensing finger (to be described).

Figure 15:
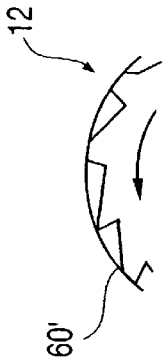
FIG. 15 is a partial profile view of a groove-forming wall surface of a main feed roller, illustrating a preferred configuration of edge serrations for facilitating a web transfer in accordance with the present invention.

Preferably, edges 60 (see FIG. 13) of grooves 37 are serrated or notched to facilitate gripping of web material during a transfer operation. A series of relatively small and shallow diagonally oriented triangular cuts can be provided on opposing groove sidewalls, as shown in FIG. 13. Alternatively, edges 60' comprising a series of cuts (e.g., ten cuts spaced in 36° angular intervals) extending perpendicular to the rotational axis of the main feed roller and at a slight angle below lines tangent to the roller, as shown in FIG. 15, can provide a greater groove surface area extending generally parallel to the entry direction of the leading end portion of web at the time of transfer. This permits greater contact with the leading web portion, and gripping of the same with increased strength, upon actuation of a transfer operation.

Figure 5:
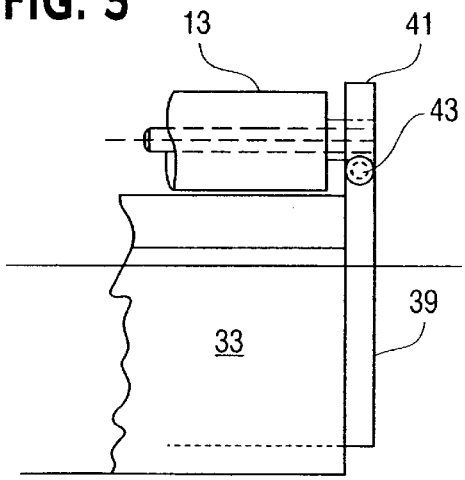
FIG. 5 is a partial front side elevation view of a web transfer arm and transfer arm extension forming part of the web sensing and transfer mechanism shown in FIG. 4, illustrating, in addition, an upper pinch roll shortened to provide clearance for engagement of a swinging stop arm and a finger of the transfer arm extension.
Figure 7:
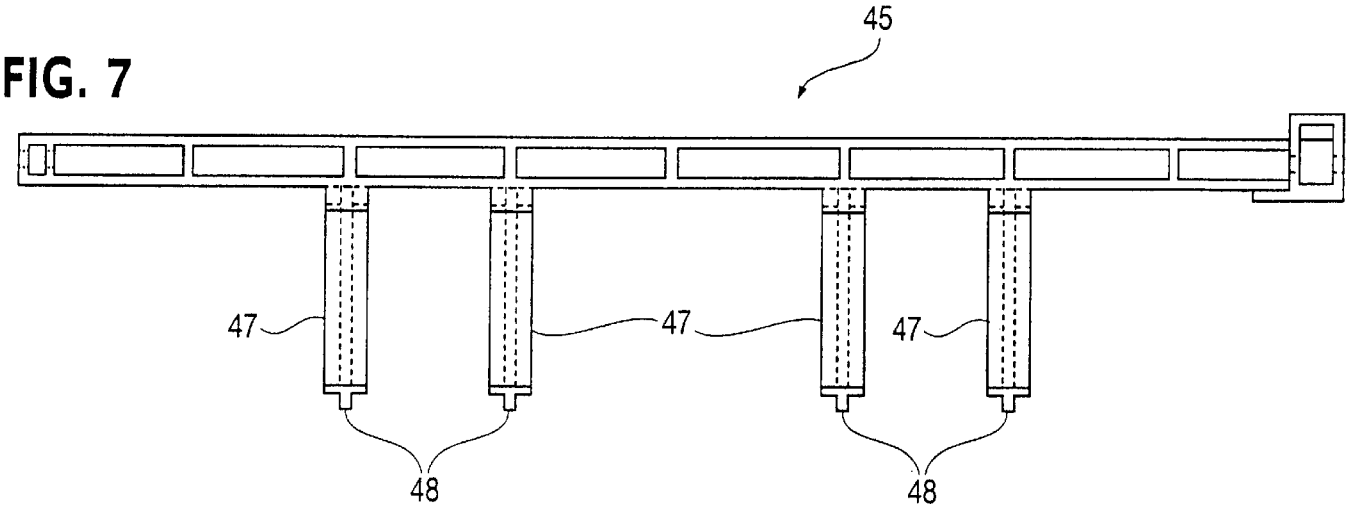
FIG. 7 is a front elevational view of the pivotable web sensing arm of FIG. 6.
Figure 9:
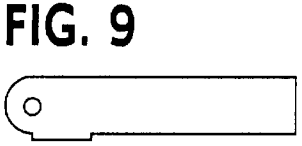
FIG. 9 is a side elevational view of the swinging stop arm seen in FIG. 4.
Figure 10:
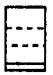
FIG. 10 is a front end elevational view of the stop arm shown in FIG. 9.
Figure 8:
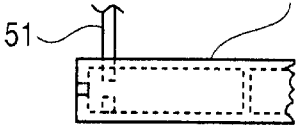
FIG. 8 is a partial top plan view of the left end of the pivotable sensing arm, and attached rearwardly extending balance arm.
Figure 6:
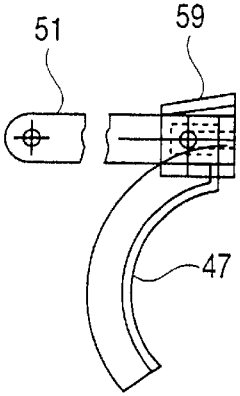
FIG. 6 is a left end view of a pivotable web sensing arm (and balance arm attached thereto), in accordance with the invention.

As best seen in FIG. 5, on one end of transfer arm 33 (right end as shown), beyond the width of a dispensed towel web and a slightly shortened upper pinch roller 13, an upwardly directed transfer arm extension 39 includes a stop finger 41 extending inwardly of the dispenser, and a coil spring 43 projecting outwardly. Spring 43 is, when the dispenser cover is fully closed, contacted by an inside surface or projection of the cover. By virtue of the resulting spring bias, spring 43 supplies a slight force serving to pivot transfer fingers 35 forward into main feed roller grooves 37, but only upon a release of the transfer arm (to be described), in order to transfer retained leading web edge 23 into the feed nip, to thereby initiate dispensing from reserve roll R. Obviously, spring 43 could be appropriately mounted on the inside of the pivotable dispenser cover, instead of on transfer arm extension 39. Transfer arm extension 39 can be located at either end of transfer arm 33, but must be arranged in alignment with a swinging stop arm (to be described).

Figure 4:
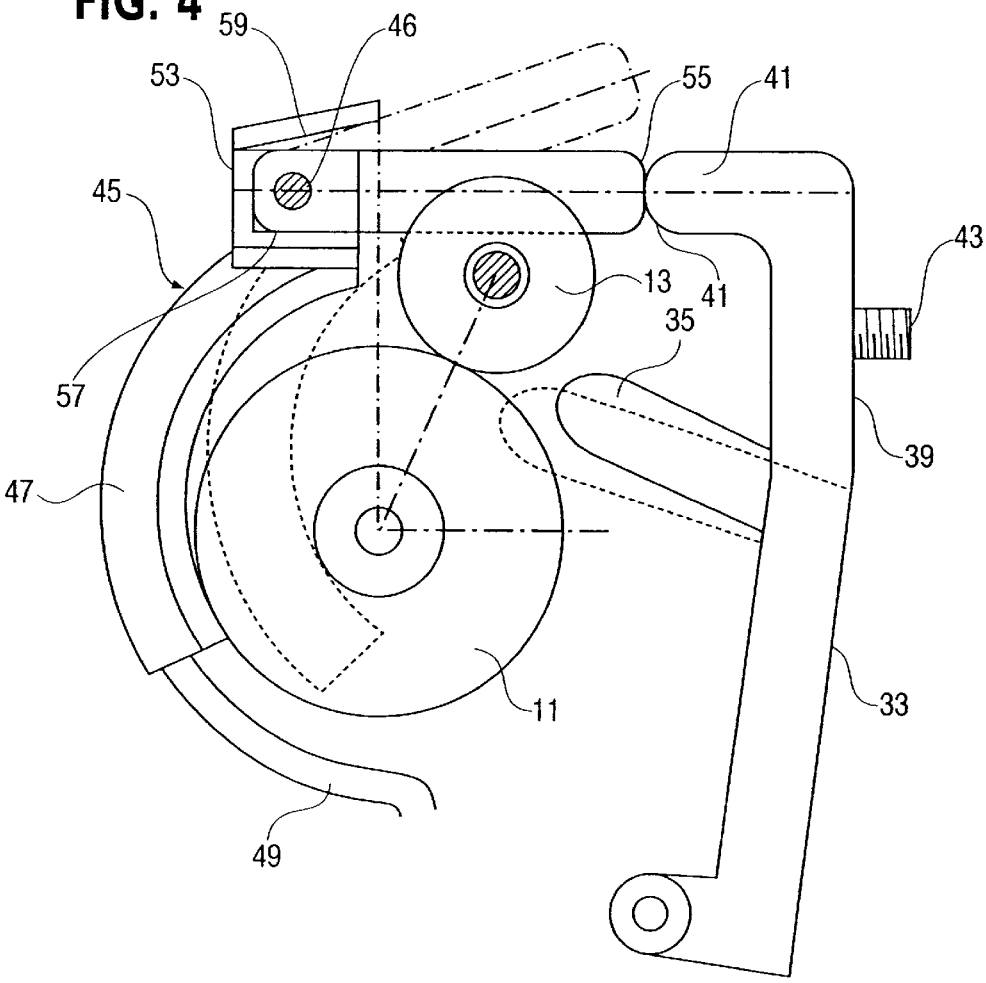
FIG. 4 is an enlarged left end view of the feed roller arrangement seen in FIG. 2, and showing a second sub-assembly (omitted in FIG. 2) of a web sensing and transfer mechanism in accordance with the present invention.

Referring now to FIG. 4, in conjunction with FIGS. 6–10, a web sensor arm 45 extends across the full width of the dispenser, at the rear of main feed roller 11, and is pivotally mounted between dispenser side plates 8, on pivot axis 46 located above and slightly rearwardly of main feed roller 11. Stub shafts (not shown) may be provided at each end of arm 45, to ride in bearings in dispenser side plates 8. A plurality of sensor fingers 47 (four shown in FIG. 7) are located along the length of arm 45 to fit into corresponding grooves 37, 38 (see FIG. 13) of main feed roller 11. Additional strength is imparted to fingers 47 by a rib 48 extending centrally along the arcuate outer surface of each finger 47. As seen in FIG. 4, an arcuate back plate 49 having slots (not shown) to accommodate fingers 47 also extends about a rear side of main feed roller 11, in order to define a path leading the web material around roller 11 and into the second nip formed between main feed roller 11 and lower pinch roller 15 (see FIG. 2).

Web sensor arm 45 is lightly loaded, preferably by a balance arm 51, or alternatively by a spring, so that sensor fingers 47 will ride lightly on the surface of a web present at the back side of feed roller 11, and pivot into the associated feed roller grooves when no web is present. The use of a balance arm is preferred since the biasing force can be maintained constant over time. The ideal balancing torque can be empirically determined for the particular dispenser application.

On the right end of sensor arm 45 is a cup-like sensor arm extension 53 (see FIG. 4), in alignment with transfer arm extension 39 located on the opposite side of main feed roller 11. Extension 53 serves to pivotably mount a swinging stop arm 55, and to predetermine the positions of arm 55 at the limits of its range of its pivotal movement. As best seen in FIG. 4, the pivot axis of stop arm 55 preferably coincides with pivot axis 46 of web sensor arm 45. Stop arm 55 has a convex end surface arranged to contact an arcuate end surface 44 of stop finger 41 of transfer arm extension 39, when sheet material webbing is present at the back side of main feed roller 11. The convex end surface of arm 55 should have a radius of curvature no larger than the radius of the pivot arc of arm 55. The mating end surfaces of stop arm 55 and stop finger 44 are preferably polished or otherwise made highly smooth. The smooth and arcuate nature of the mating end surfaces reduces friction and thereby facilitates a release-action to be described.

Cup-like sensor arm extension 53 has a lower inner surface 57 that positively lifts stop arm 55 for effecting a transfer of web feed. Extension 53 has a sloping upper inner surface 59 that limits upward movement of stop arm 55, but allows stop arm 55 to pivot sufficiently within the cup to rest, in one stage of the operation (to be described), on top of transfer arm extension finger 41. This occurs when transfer arm 33 is in a forward, transfer positioned when sensor fingers 47 are located outside of the feed roller grooves, in a web present position.

The components of the inventive web transfer mechanism may be manufactured using known materials and manufacturing techniques. For example, durable thermoplastic plastic material, e.g., DELRIN or equivalent, and injection molding, can be used to form stripper bar 22 (and integral arms 27), shield 19, web retainer plates 21, web transfer arm 33 (and integral extension 39), web sensor arm 45 (including integral cup-like extension 53 and fingers 47), and swinging stop arm 55. The feed rollers may comprise molded plastic hubs on circular steel shafts, and separately applied rubber facing surfaces. Various other suitable materials and manufacturing methods will be apparent to those skilled in the art.

Sequential operation stages of the above-described inventive web transfer system are now explained.

1. Dispenser Empty, Cover Closed

Without web material present at its backside, main feed roller 11 has allowed pivoted web sensor arm 45, loaded by balance arm 51 at the rear, to pivot sensor fingers 47 into corresponding grooves 37, 38 provided in main feed roller 11 (see FIG. 13). This causes swinging stop arm 55 to be lifted upwardly, as seen in FIG. 4, releasing transfer arm extension 39, at the front side of main feed roller 11, to pivot inwardly of the dispenser under the bias of spring 43 contacted by pressure of the closed cover 1. This causes transfer fingers 35 to pivot into exposed feed roller grooves 37 at the front side of main feed roller 11.

2. Cover Opens

Figure 11:
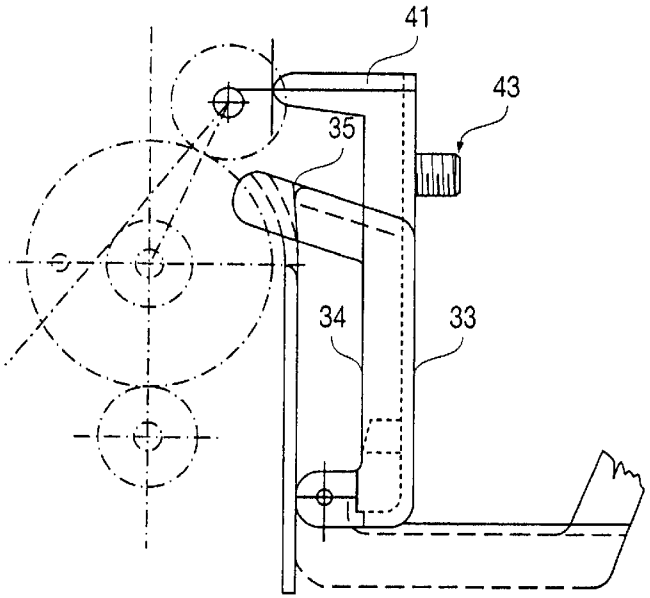
FIG. 11 is a left end elevational view of the swinging transfer arm shown in FIG. 4, and illustrating more clearly its pivotable mount to the shield.
Figure 14:
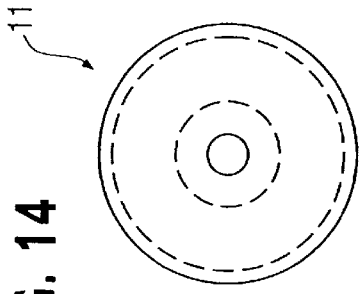
FIG. 14 is an end elevational view of the main feed roll shown in FIG. 11.

As dispenser cover 1 is pivoted downwardly about pivot point 3 to an open position, the spring pressure on transfer arm extension 39 is relieved, allowing transfer arm 33 to drop by gravity to the position shown by the phantom lines in FIG. 11, leaving a clear area in front of main feed roller 11. The custodian loads a towel roll into reserve roll wing members 7 (see FIG. 1), then leads web end 23 down in front of feed roller shield 19, and into the retainer clips formed by retainer plates 21 and flat springs 25.

3. Cover Closes

As cover 1 is closed, it pivots transfer arm 33 upwardly, allowing transfer arm extension arm finger 41 to pass under raised stop arm 55. By pressure from cover 1 contacting spring 43, transfer arm 33 is actuated to move transfer fingers 35 into pressing contact with portions of the towel web adjacent retained edge 23, to thus force the web portions at least partially into feed roller grooves 37, where serrated edges 60 (or 60') of the grooves (see FIGS. 13 and 15) assist with gripping of the web material on rotation of feed roller 11. Subsequent power or manual operation of feed roller 11 pulls the towel web out of the retainers, folds leading end portion 23 over, and carries the folded end portion around to the rear of main feed roller 11. At this point, the web contacts the ends of sensor fingers 47 and lifts the fingers out of the feed roller grooves 37 to ride on the surface of the web. Simultaneously, cup-like sensor arm extension 53 is pivoted downwardly. Swinging stop arm 55 remains on top of transfer arm extension finger 41, as stop arm 55 pivots freely in the ample clearance provided by the cup-like structure. On the front side of main feed roller 11, transfer fingers 35 remain in open feed roller grooves 37; at the rear, sensor fingers 47 ride on the surface of the towel web, as the sheet material (e.g., towels) is being dispensed.

4. Indicator (or transparent window) on Cover Alerts Custodian that Initial Towel Roll has Reduced to Stub-roll Size. Cover Opened.

As dispenser cover 1 is pivoted open, transfer arm 33 drops once again, by gravity, to the open position shown in FIG. 11, pivoting transfer arm extension finger 41 out from under swinging stop arm 55. This permits stop arm 55 to drop to its lowermost, horizontal stop position. A custodian removes the remains of roll R (now a stub roll 16) from its support wings 7 and drops it into the bottom compartment (see FIG. 1). The web of stub roll 16 remains threaded through the mechanism, as seen in FIG. 1. The custodian loads a fresh reserve roll R into wing members 7, threads the leading end portion of the web down in front of main feed roller 11, and slides the leading web edge into the spring clips formed by retainer plates 21 and flat springs 25. (The steps of loading a reserve roll are the same as loading the initial roll in previous stage 2.)

5. Cover Closes

Closing of cover 1, following loading of reserve roll R, pivots transfer arm 33 upwardly, but the end of transfer arm extension finger 41 hits the free end surface of swinging stop arm 55, which is placed in its lower stop position, as seen in FIG. 4. This prevents transfer fingers 35 from pivoting into feed roller grooves 37, to transfer the reserve web. Dispensing continues until stub roll 16 in the lower compartment runs empty. As the trailing end of the stub roll web passes over the rear side of main feed roller 11, sensor fingers 47 pivot into feed roller grooves 37, simultaneously raising cup-like sensor arm extension 53, and the pivoted stop arm 55. This releases transfer arm extension 39, allowing the spring-loaded transfer arm 33 to pivot transfer fingers 35 into feed roller grooves 37, under the bias of spring 43, to thus transfer feed to the reserve web upon rotation of feed roller 11 (in the manner described in previous stage 3). As the reserve roll web moves around and down the back side of feed roller 11, it contacts sensor fingers 47, pivoting them back to once again ride on the surface of the web, simultaneously moving sensor arm extension 53 down, to once again let swinging stop arm 55 rest on top of the transfer arm extension finger 41. The empty core in the lower compartment rests on the cover bottom. Thus, when the custodian later opens the cover to load a fresh reserve roll, the empty core will roll forwardly in the cover bottom where it can be easily removed.

The present invention has been described in terms of preferred and exemplary embodiments thereof Numerous other embodiments, modifications and variations within the scope and spirit of the appended claims will occur to persons of ordinary skill in the art from a review of this disclosure.

What is claimed is:

1. A web transfer mechanism for providing, in a flexible sheet material dispenser, automatic transfer of web feed from a working roll to a reserve roll, comprising:

a pair of feed rollers forming a nip for receiving a leading end of a sheet material web, a first one of said feed rollers including at least one circumferential groove;

a first arm movably mounted adjacent and to one side of said first feed roller, said first arm including a web transfer finger, said finger being movable into contact with a leading end portion of a sheet material web from said reserve roll, positioned on said one side of the first feed roller, to a transfer position close enough to said first feed roller to move said leading end portion into the vicinity of said nip such that upon driving of the feed rollers the web of the reserve roll is carried through the nip and along a path avoiding subsequent contact of the web with said finger;

a second arm movably mounted adjacent and to a second side of said first feed roller, said second arm including a web sensing finger biased toward said feed roller into a web-present sensing position wherein said sensing finger rides lightly upon the surface of a sheet material web as it passes around said first feed roller, and such that when no sheet material web is present said sensing finger moves into a no-web-present position within a said at least one circumferential groove;

a stop arm connected to said second arm, said stop arm being movable to a stop position preventing said web transfer finger from moving into said transfer position when said web sensing finger is in said web-present sensing position, said stop arm being movable with said second arm to a release position allowing said web transfer finger to move into said transfer position when said second arm moves into said no-web-present position.

2. A web transfer mechanism according to claim 1, wherein said first arm is pivotably mounted on a first pivot axis, said second arm is pivotably mounted on a second pivot axis, and said stop arm is pivotably connected to said second arm.

3. A web transfer mechanism according to claim 2, wherein said second arm is biased by gravity to pivot said web sensing finger toward the feed roller.

4. A web transfer mechanism according to claim 3, wherein said second arm comprises a balance arm extending outwardly from the pivot axis of the second arm, above said web sensing finger.

5. A web transfer mechanism according to claim 2, wherein said second arm comprises a plurality of said web sensing fingers, and said feed roller comprises a plurality of grooves aligned, respectively, with said web sensing fingers.

6. A web transfer mechanism according to claim 2, wherein the second pivot axis of said second arm is mounted to extend above said feed roller and said web sensing finger extends in an arc about a backside of said feed roller opposite the side at which the web enters the nip.

7. A web transfer mechanism according to claim 2, wherein the stop arm is pivotably connected to said second arm coaxially with the axis which pivotably mounts the second arm.

8. A web transfer mechanism according to claim 7, wherein an end of said stop arm is pivotably accommodated within a cup-like structure mounted at an end of said second arm, said cup-like structure serving to support said stop arm in a generally horizontal orientation in said stop position and in an inclined orientation in said release position, an d to allow upward pivoting of the stop arm within the cup-like structure such that the stop arm may rest upon a portion of said lever arm following transfer of web into said nip.

9. A web transfer mechanism according to claim 8, wherein the pivot axis of said first arm is located below said first one of said feed rollers and said first arm is biased by gravity to fall away from said nip when a cover of the dispenser is in an open position.

10. A web transfer mechanism according to claim 9, wherein when said dispenser cover is closed said first arm is spring biased to move said web transfer finger to said transfer position.

11. A web transfer mechanism according to claim 10, wherein said first arm comprises an extension portion extending above said transfer finger which prevents said finger from moving to said transfer position by abutting with said stop arm when said cover is closed with said stop arm in the stop position.

12. A web transfer mechanism according to claim 2, wherein the transfer position of said web transfer finger is within a said groove in the feed roller.

13. A web transfer mechanism according to claim 2, wherein said first arm comprises a plurality of said web transfer fingers, and said feed roller comprises a plurality of grooves aligned, respectively, with said web transfer fingers.

14. A web transfer mechanism according to claim 2, further comprising a retaining mechanism serving to removably secure said leading end portion of sheet material web on said one side of the first feed roller.

15. A web transfer mechanism according to claim 14, wherein said retaining mechanism comprises a clip formed by a flat spring placed in pressing contact with an adjacent plate.

16. A web transfer mechanism according to claim 15, further comprising a stripper bar and shield extending along said first feed roller, said flat spring being mounted to said stripper bar and extending into said pressing contact with the plate through an aperture in said shield.

17. A web transfer mechanism for providing, in a flexible sheet material dispenser, automatic transfer of web feed from a working roll to a reserve roll, comprising:

a pair of feed rollers forming a nip for receiving a leading end of a sheet material web, a first one of said feed rollers including at least one circumferential groove with serrations formed in a sidewall thereof; and a web transfer arm movably mounted adjacent said first feed roller, said arm being movable into contact with a leading end portion of a sheet material web from said reserve roll, positioned on a side of the first feed roller, to a transfer position close enough to said first feed roller to move said leading end portion into the vicinity of said nip such that upon driving of the feed rollers the web of the reserve roll is gripped by said first feed roller, assisted by said serrations, and carried through the nip.

18. A web transfer mechanism according to claim 17, wherein said serrations are provided on each of opposing groove sidewalls.

19. A web transfer mechanism according to claim 17, wherein said serrations comprise a series of diagonally oriented generally triangular cuts.

20. A web transfer mechanism according to claim 17, wherein said serrations comprise a series of cuts extending perpendicular to the rotational axis of the feed roller.

21. A web transfer mechanism according to claim 20, wherein said series of cuts consist of ten cuts provided at spaced angular intervals of 36°.

22. A web transfer mechanism according to claim 17, wherein said web transfer arm comprises a web transfer finger, and when said arm is in said transfer position, said web transfer finger is positioned within said groove.

* * * * *

UNITED STATES PATENT AND TRADEMARK OFFICE

CERTIFICATE OF CORRECTION

PATENT NO. : 6,354,533 B1
DATED : March 12, 2002
INVENTOR(S) : Paul W. Jespersen It is certified that error appears in the above-identified patent and that said Letters Patent is hereby corrected as shown below:

Column 7,
Line 34, "positioned" has been replaced with -- positioned and --.

Column 9,
Line 15, insert -- . -- after "thereof".

Signed and Sealed this

Twenty-fifth Day of June, 2002

*Attest:*

*Attesting Officer*

JAMES E. ROGAN
*Director of the United States Patent and Trademark Office*